US008107830B2

(12) United States Patent
Ozeki

(10) Patent No.: US 8,107,830 B2
(45) Date of Patent: Jan. 31, 2012

(54) IMAGE FORMING APPARATUS AND METHOD OF DISCARDING DEVELOPER

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 737 days.

(21) Appl. No.: 12/289,577

(22) Filed: Oct. 30, 2008

(65) Prior Publication Data

US 2009/0123166 A1 May 14, 2009

(30) Foreign Application Priority Data

Nov. 13, 2007 (JP) ..... 2007-294208

(51) Int. Cl.
*G03G 15/08* (2006.01)

(52) U.S. Cl. ..... 399/27; 399/44; 399/58

(58) Field of Classification Search ..... 399/44, 399/27, 58, 66

See application file for complete search history.

(56) References Cited

U.S. PATENT DOCUMENTS

| | | | | |
|---|---|---|---|---|
| 6,510,294 | B1 * | 1/2003 | Hakamada | 399/58 |
| 2005/0185975 | A1 * | 8/2005 | Kobayashi et al. | 399/44 |

FOREIGN PATENT DOCUMENTS

| | | |
|---|---|---|
| JP | 2003-005608 | 1/2003 |
| JP | 2004-045481 | 2/2004 |
| JP | 2004-301948 | 10/2004 |
| JP | 2006-209107 | 8/2006 |

* cited by examiner

*Primary Examiner* — David Gray
*Assistant Examiner* — Roy Y Yi
(74) *Attorney, Agent, or Firm* — Kubotera & Associates, LLC

(57) ABSTRACT

An image forming apparatus includes a plurality of image forming units each having an image supporting member, a developer supporting member, and a cleaning member for cleaning developer on the image supporting member. The image forming apparatus further includes a transfer device for transferring a developer image to a medium; a fixing device for fixing the developer image to the medium; a first detection unit for detecting a first physical value of an external environment of the image forming apparatus; a second detection unit for detecting a second physical value of an internal environment of the image forming apparatus; and a control unit for determining whether at least one of the image forming units performs a developer discard mode in which developer is discarded according to the first physical value, the second physical value, and a distance between the one of the image forming units and the fixing device.

15 Claims, 7 Drawing Sheets

IMAGE FORMING APPARATUS AND METHOD OF DISCARDING DEVELOPER

BACKGROUND OF THE INVENTION AND RELATED ART STATEMENT

The present invention relates to an image forming apparatus and a method of discarding developer in the image forming apparatus.

A conventional image forming apparatus of an electrophotography type includes a photosensitive drum, a charge roller, an exposure device, a developing device, a transfer roller, and a cleaning member. The charge roller charges the photosensitive drum, and the exposure device forms a static latent image, so that the developing device develops the static latent image to form a toner image. Then, the transfer roller transfers the toner image to a sheet, and a fixing device fixes the toner image followed by discharging the sheet. The cleaning member removes toner remaining on the photosensitive drum after the transfer roller transfers the toner image to the sheet, In the conventional image forming apparatus of an electrophotography type, when toner remains in the developing device without being developed, toner may be accumulated in the developing device while being deteriorated with time. As a result, toner thus accumulated and deteriorated may cause a trouble such as an uneven density of a printed image, lowering of dot reproducibility, and fog. To this end, a technology has been developed in which toner is discarded after a specific number of sheets are printed (refer to Patent Reference).

Patent Reference: Japan Patent Publication No. 2004-45481

In the conventional image forming apparatus disclosed in Patent Reference, toner is discarded after a specific number of sheets are printed. Accordingly, it is necessary to consume a relatively large amount of toner.

In view of the problems described above, an object of the present invention is to provide an image forming apparatus and a method of discarding developer in the image forming apparatus through discarding toner. In the image forming apparatus of the present invention, it is possible to reduce an amount of toner to be discarded.

Further objects of the invention will be apparent from the following description of the invention.

SUMMARY OF THE INVENTION

In order to attain the objects described above, in an image forming apparatus according to a first aspect of the present invention, toner is discarded only in an image forming unit with propensity of causing a filming according to a relationship between an inner temperature of the image forming apparatus and an absolute water vapor amount.

According to the first aspect of the present invention, the image forming apparatus includes a plurality of image forming units each having an image supporting member, a developer supporting member, and a cleaning member disposed to face the image supporting member for cleaning developer on the image supporting member.

The image forming apparatus further includes a transfer device for transferring a developer image formed on the image supporting member to a medium; a fixing device for fixing the developer image to the medium through heat; a first detection unit for detecting a first physical value of an external environment of the image forming apparatus; a second detection unit for detecting a second physical value of an internal environment of the image forming apparatus; and a control unit for determining whether at least one of the image forming units performs a developer discard mode in which developer is discarded from the developer supporting member to the image supporting member according to the first physical value, the second physical value, and a distance between the at least one of the image forming units and the fixing device.

In the first aspect of the present invention, in the image forming apparatus, toner in all of the image forming units is not necessarily discarded. Instead, toner is discarded only in an image forming unit with propensity of causing a filming according to a relationship between an inner temperature of the image forming apparatus and an absolute water vapor amount. Accordingly, it is possible to reduce an amount of toner to be discarded.

DETAILED DESCRIPTION OF THE PREFERRED EMBODIMENTS

Figure 1:
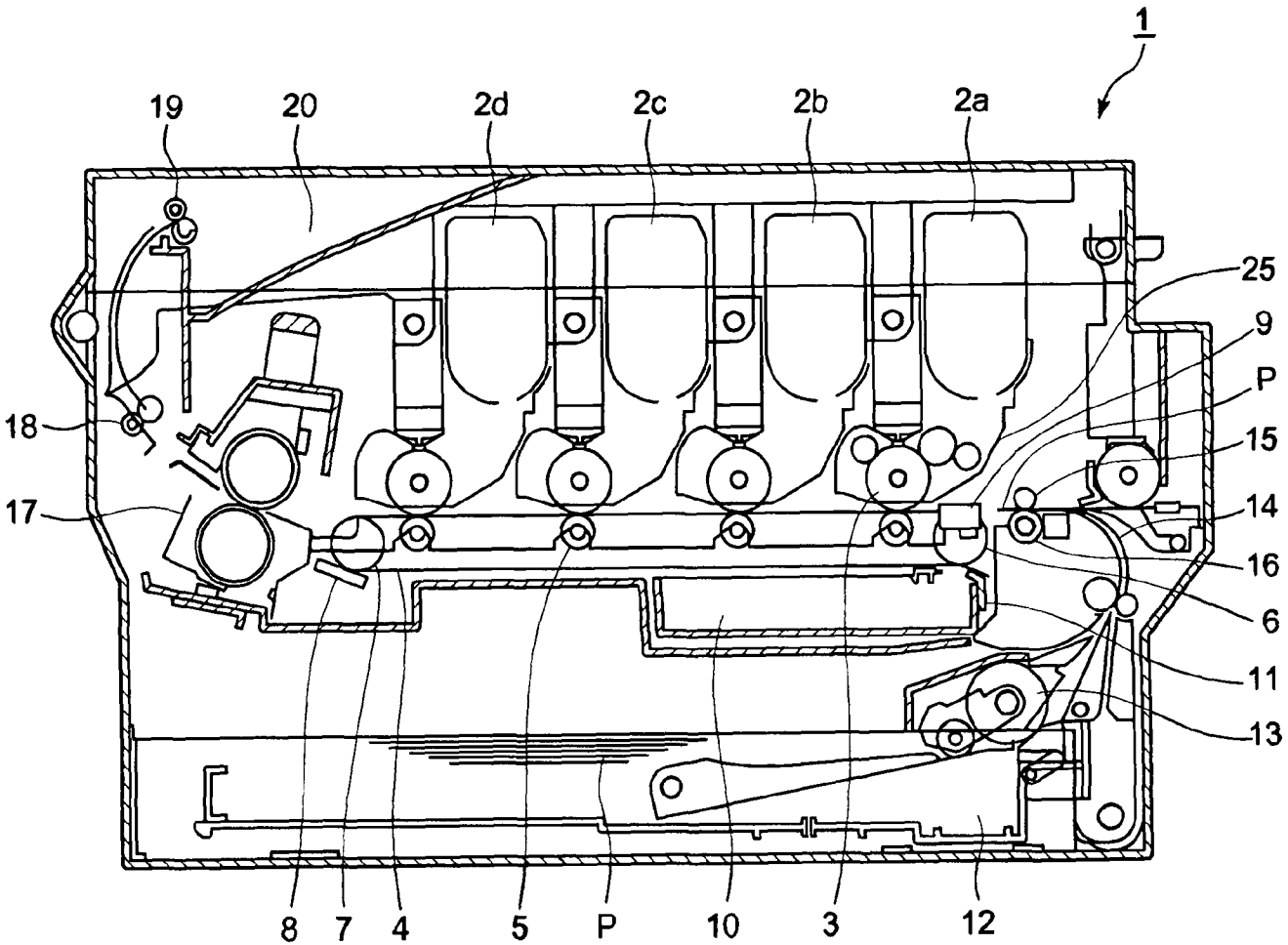
FIG. 1 is a schematic view showing an image forming apparatus according to a first embodiment of the present invention.

Hereunder, embodiments of the present invention will be described in detail with reference to the accompanying drawings. In the drawings, common components are designated with same reference numerals.

First Embodiment

A first embodiment of the present invention will be explained. FIG. 1 is a schematic view showing an image forming apparatus 1 according to the first embodiment of the present invention.

As shown in FIG. 1, the image forming apparatus 1 includes image forming units 2*a*, 2*b*, 2*c*, and 2*d* arranged in series. Each of the image forming units 2*a*, 2*b*, 2*c*, and 2*d* includes a developing device 25 (described later), and stores toner in different colors. More specifically, the image forming unit 2*a* stores toner in black; the image forming unit 2*b* stores toner in yellow; the image forming unit 2*c* stores toner in magenta; and the image forming unit 2*d* stores toner in cyan.

In the embodiment, a housing of the image forming apparatus 1 includes a cover disposed at an upper portion thereof to be capable of opening and closing, so that the image forming units 2*a*, 2*b*, 2*c*, and 2*d* can be replaced. Each of the image forming units 2*a*, 2*b*, 2*c*, and 2*d* includes a photosensitive member 3 to be rotatable at a specific rotational speed. A surface of the photosensitive member 3 is capable of accumulating charges, and also capable of releasing charges upon exposure. The photosensitive member 3 is formed of, for example, an organic photosensitive material.

In the embodiment, a transfer belt 4 and transfer rollers 5 are disposed as transfer members under the photosensitive members 3. The transfer belt 4 is placed between an idle roller 6 and a drive roller 7 to be rotatable, so that the drive roller 7 drives the transfer belt 4 to rotate. The transfer roller 5 is provided for transferring a toner image on the photosensitive member 3 to a recording medium P, and is disposed under each of the photosensitive members 3. A power source (not shown) applies a voltage to the transfer belt 4 and the transfer rollers 5.

In the embodiment, a temperature sensor 8 is disposed under the drive roller 7 to contact with the transfer belt 4 for detecting an internal temperature of the image forming apparatus 1. A temperature humidity sensor 9 is disposed near the idle roller 6 at a side portion of the image forming apparatus 1 for detecting an external temperature and an external humidity of the image forming apparatus 1. The temperature sensor 8 may be 103ET-1 (a product of Ishizuka Electronics Corporation), and the temperature humidity sensor 9 may be MSM3103J375J and HIS-05-N (products of Hokuriku Electric Industry Co., Ltd.).

In the embodiment, a toner collection container 10 is disposed under the transfer belt 4. When toner attaches to the transfer belt 4 due to a trouble in transporting a sheet, a transfer belt cleaning blade 11 remove toner from the transfer belt 4, so that toner is collected in the toner collection container 10.

In the embodiment, a medium tray 12 is disposed at a lower portion of the image forming apparatus 1 for storing the recording medium P. A hoping roller 13 picks up and transports the recording medium P to a transportation path 14 one by one. A register roller 15 or a pressure roller is provided in the transportation path 14 for transporting the recording medium P to the transfer belt 4 without skew. Further, a register roller 16 or a feed roller is provided in the transportation path 14 for transporting the recording medium P to the transfer belt 4.

In the embodiment, a fixing device 17 is disposed on a downstream side of the drive roller. 7 in a direction that the recording medium P is transported. The fixing device 17 fixes toner transferred on the recording medium P to the recording medium P through heat. Discharge rollers 18 and 19 are disposed on a downstream side of the fixing device 17 in the direction that the recording medium P is transported. The discharge rollers 18 and 19 discharge the recording medium P to a discharge unit 20 after the fixing device 17 fixes toner.

Figure 2:
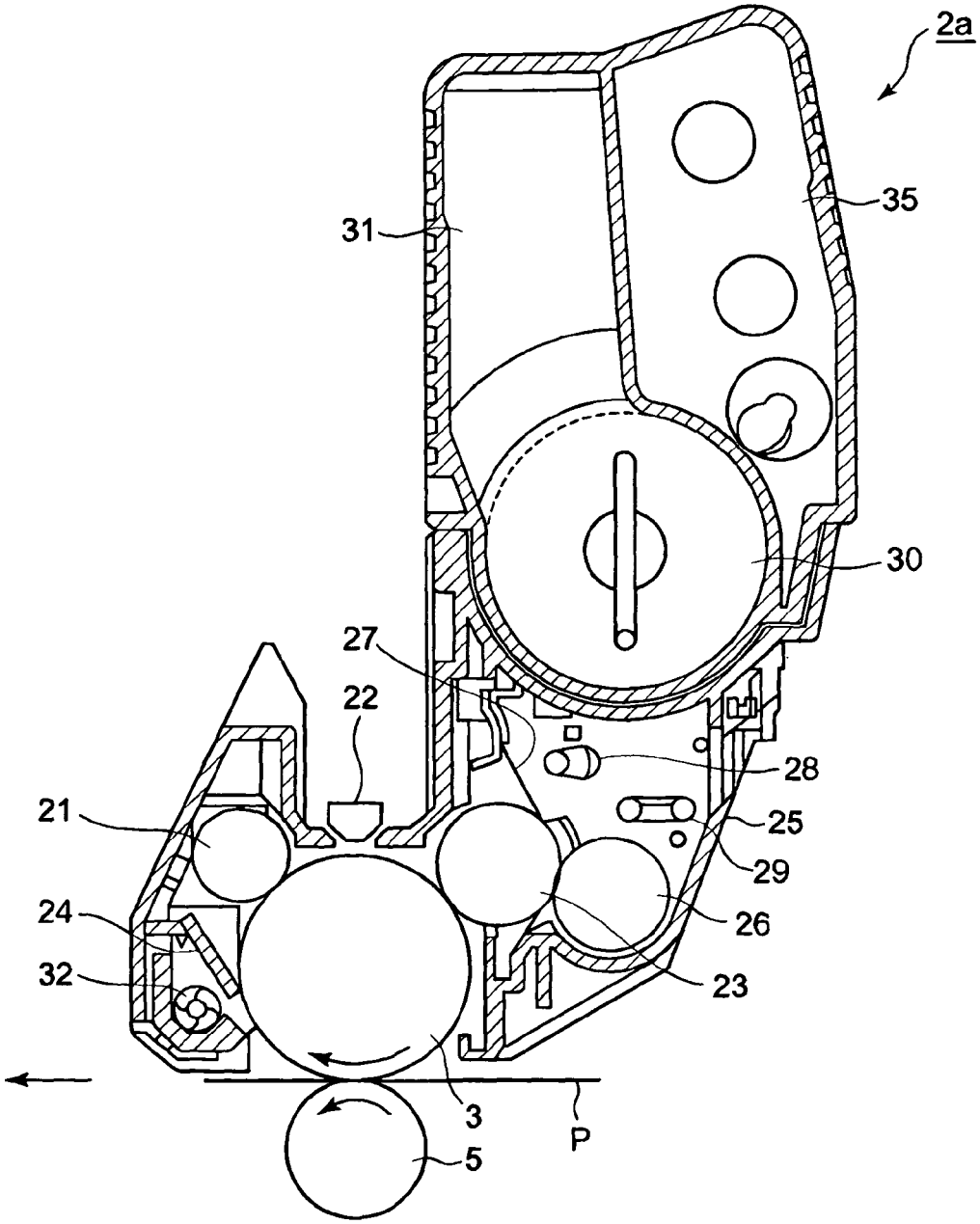
FIG. 2 is a schematic view showing an image forming unit of the image forming apparatus according to the first embodiment of the present invention.
Figure 3:
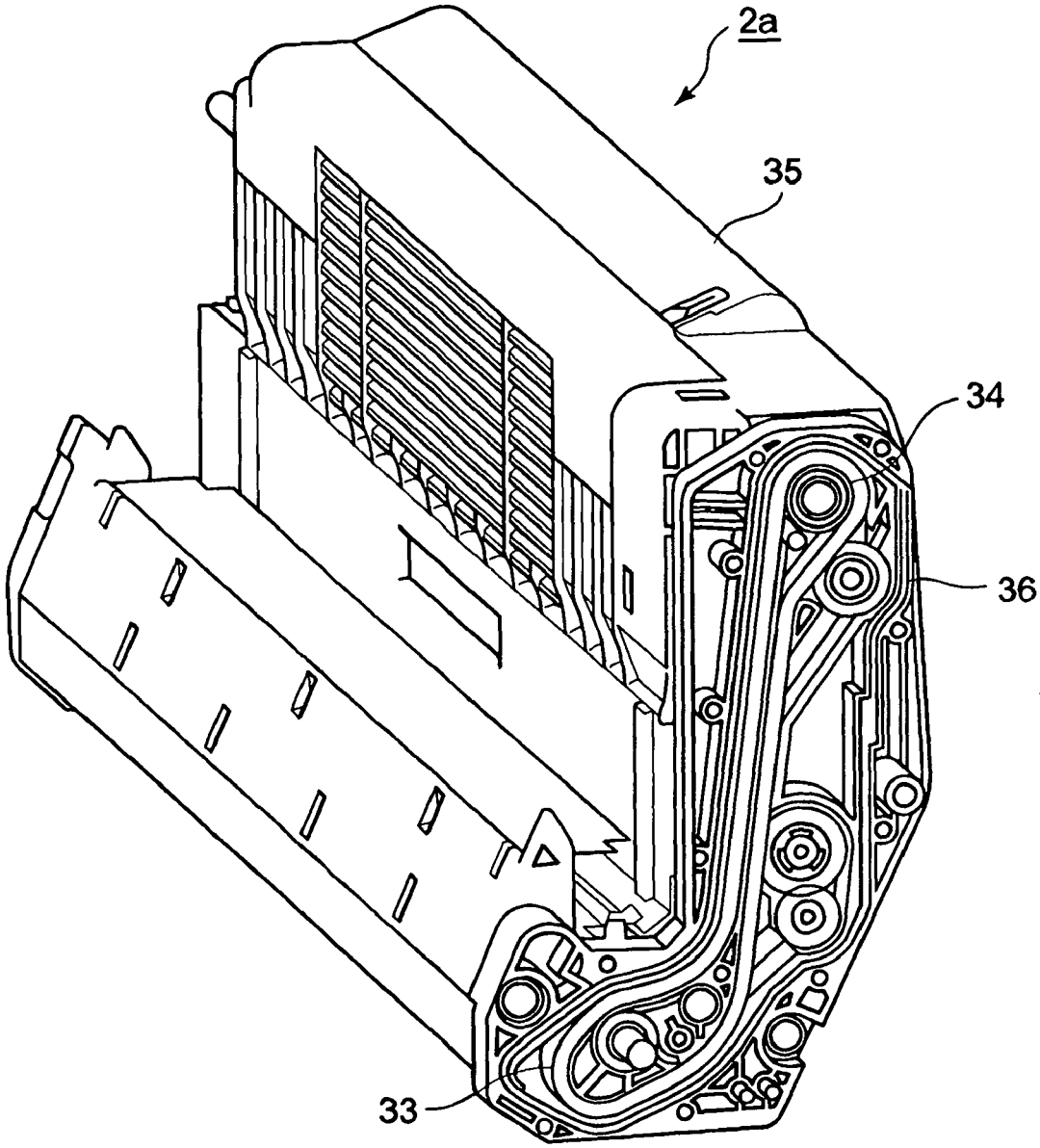
FIG. 3 is a perspective view showing a toner collection unit of the image forming apparatus according to the first embodiment of the present invention.

FIG. 2 is a schematic view showing the image forming unit 2*a* of the image forming apparatus 1 according to the first embodiment of the present invention. FIG. 3 is a perspective view showing a toner collection unit of the image forming apparatus 1 according to the first embodiment of the present invention.

In the embodiment, the image forming units 2*a*, 2*b*, 2*c*, and 2*d* have an identical configuration. Accordingly, the image forming unit 2*a* will be explained. As shown in FIG. 2, a charge roller 21, an LED (Light Emitting Diode) head 22, a developing roller 23, and a cleaning blade 24 are disposed around the photosensitive member 3 of the image forming unit 2*a*.

In the embodiment, the charge roller 21 applies a specific voltage to a surface of the photosensitive member 3. Further, the charge roller 21 contacts with the surface of the photosensitive member 3 with a specific pressure, and rotates in a direction opposite to that of the photosensitive member 3. The charge roller 21 may be formed of a silicone resin or a urethane resin. The LED head 22 is an exposure member for forming a static latent image on the surface of the photosensitive member 3 according to print data. The exposure member may be formed of a laser other than an LED.

In the embodiment, the developing device 25 includes the developing roller 23, a supply roller 26, a developing blade 27, a stirring member 28, and a toner transportation member 29. The developing roller 23 contacts with the photosensitive member 3 with a specific pressure, so that the developing roller 23 supplies toner to the static latent image formed on the surface of the photosensitive member 3 to develop the static latent image. The developing roller 23 may be formed of a silicone resin or a urethane resin.

In the embodiment, the supply roller 26 contacts with the developing roller 23 with a specific pressure, so that the supply roller 26 supplies toner to the developing roller 23. The supply roller 26 may be formed of a foamed elastic member such as a foamed member of a silicone resin or a urethane resin, so that the supply roller 26 has a plurality of cells (not shown) formed of recess portions in a surface thereof. The developing blade 27 contacts with the developing roller 23 with a specific pressure, so that the developing blade 27 regulates toner supplied to the developing roller 23 at a constant thickness.

In the embodiment, a toner cartridge 31 is disposed above the developing device 25 for storing toner 30. A shutter is disposed at a lower portion of the toner cartridge 31. When the shutter opens, the toner 30 is supplied into the developing device 25. After the toner 30 is supplied, the stirring member 28 stirs the toner 30, and the toner transportation member 29 transports the toner 30 to the supply roller 26.

In the embodiment, an edge portion of the cleaning blade 24 contacts with the surface of the photosensitive member 3 with a specific pressure, so that the cleaning blade 24 scrapes off toner remaining on the surface of the photosensitive member 3 after the transfer roller 5 transfers the toner image to the recording medium P. The cleaning blade 24 has the following physical properties.

TABLE 1

| | |
|---|---|
| Hardness (JIS-A) | 75 |
| 100% Modulus (Kgf/cm$^2$) | 42 |
| 200% Modulus (Kgf/cm$^2$) | 70 |
| 300% Modulus (Kgf/cm$^2$) | 128 |
| Tensile strength (Kgf/cm$^2$) | 750 |
| Elongation (%) | 457 |
| Tearing strength (JIS-B) (Kgf/cm$^2$) | 58.6 |
| Tensile Modulus (Kgf/cm$^2$) | 76.3 |
| Permanent elongation (200% elongation × 10 min.) (%) | 3.9 |
| Rebound resilience (%) 23° C. | 49 |
| tan δ peak temperature (° C.) | −4 |

In the embodiment, after the cleaning blade 24 scrapes off toner, a spiral 32 transports toner in a lateral direction toward a side portion of the image forming unit 2*a*, thereby collecting toner in a waste toner container 35. As shown in FIG. 3, the waste toner container 35 is disposed at a lower portion of the image forming unit 2*a*. After toner is transported, toner is collected temporarily.

As shown in FIG. 3, the image forming unit 2*a* includes a waste toner transportation box 33 at a lower side portion thereof and a waste toner collection box 36 at an upper portion thereof. A continuous groove with a loop shape is formed between the waste toner transportation box 33 and the waste toner collection box 36.

In the embodiment, a waste toner transportation belt 34 with an endless shape is retained in the continuous groove. The waste toner transportation belt 34 has a teeth portion on an outer portion thereof. The teeth portion has a recess portion for transporting toner. Accordingly, the waste toner transportation belt 34 transports waste toner collected in the waste toner transportation box 33 to the waste toner collection box 36 at the upper portion.

In the embodiment, the waste toner collection box 36 is provided with a spiral (not shown) for transporting waste toner transported to the waste toner collection box 36 to the waste toner container 35 in a lateral direction.

Figure 4:
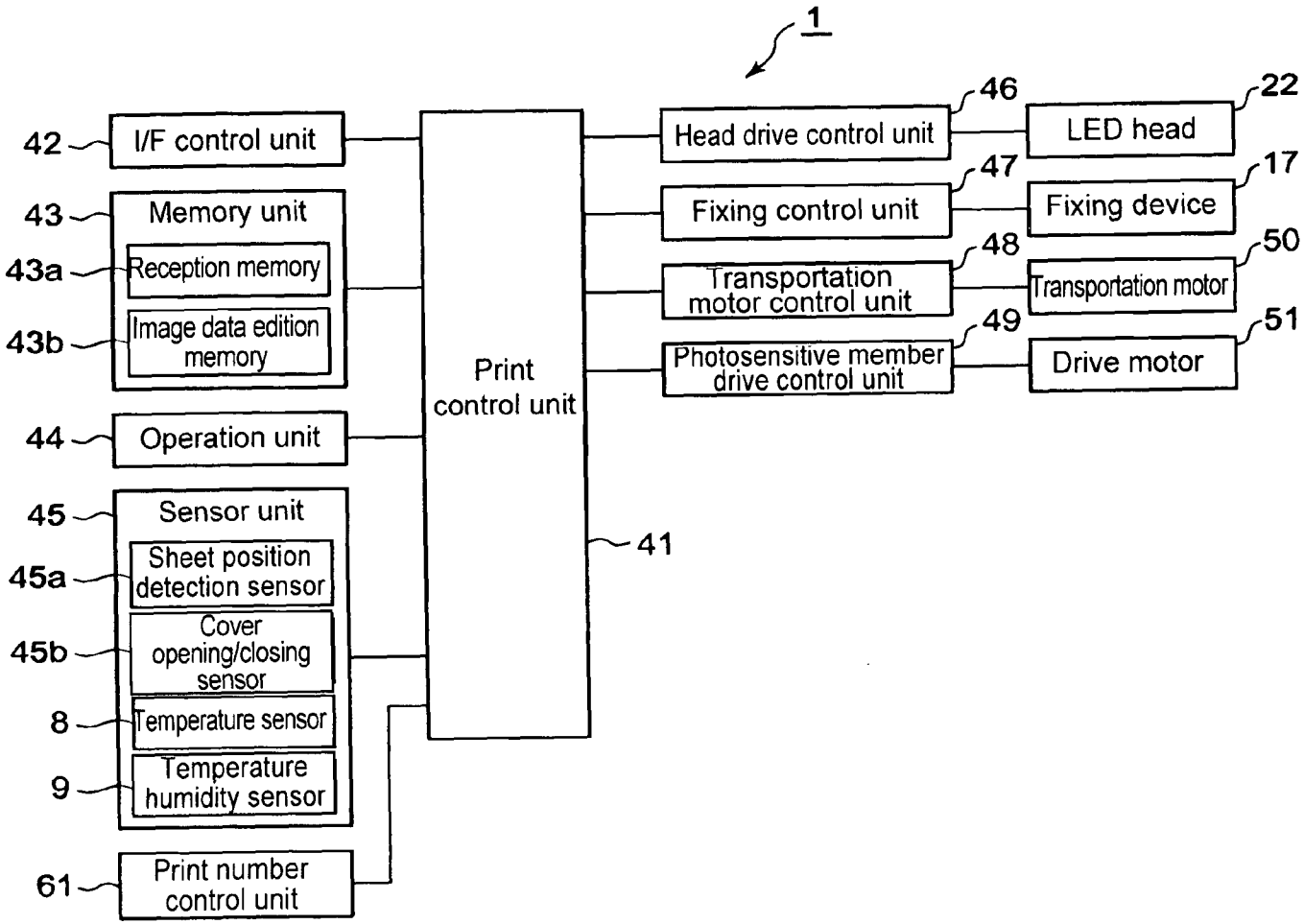
FIG. 4 is a block diagram showing a control system of the image forming apparatus according to the first embodiment of the present invention.

FIG. 4 is a block diagram showing a control system of the image forming apparatus 1 according to the first embodiment of the present invention.

As shown in FIG. 4, the image forming apparatus 1 includes a print control unit 41 formed of a microprocessor, an ROM (Read Only Memory), an RAM (Random Access Memory), an input/output port, a timer, and the likes. The print control unit 41 controls an entire operation of the image forming apparatus 1. The print control unit 41 includes an interface (I/F) control unit 42, a memory unit 43, an operation unit 44, a sensor unit 45, and a print number counter unit 61.

In the embodiment, the interface control unit 42 receives print data and a control command from a host device (not shown) for an entire sequence of the image forming apparatus 1. The memory unit 43 includes a reception memory 43*a* for temporarily storing the print data through the interface control unit 42, and an image data edition memory 43*b* for receiving the print data stored in the reception memory 43*a* and for storing image data created through editing the print data.

In the embodiment, the operation unit 44 includes a switch (not shown) and the likes for sending a direction of an operator to the image forming apparatus 1. The sensor unit 45 includes various sensors for monitoring an operational state of the image forming apparatus 1, for example, a sheet position detection sensor 45*a*, a cover opening/closing sensor 45*b*, the temperature sensor 8, and the temperature humidity sensor 9.

In the embodiment, the print control unit 41 is connected to a head drive control unit 46; a fixing control unit 47; a transportation motor control unit 48; and a photosensitive member drive control unit 49, so that the print control unit 41 controls each control unit.

In the embodiment, the head drive control unit 46 sends the image data stored in the image data edition memory 43*b* to the LED head 22 to drive the LED head 22. The fixing control unit 47 applies a voltage to the fixing device 17. The transportation motor control unit 48 controls a transportation motor 50 for transporting the recording medium P. The photosensitive member drive control unit 49 drives a drive motor 51 for rotating the photosensitive member 3.

Figure 5:
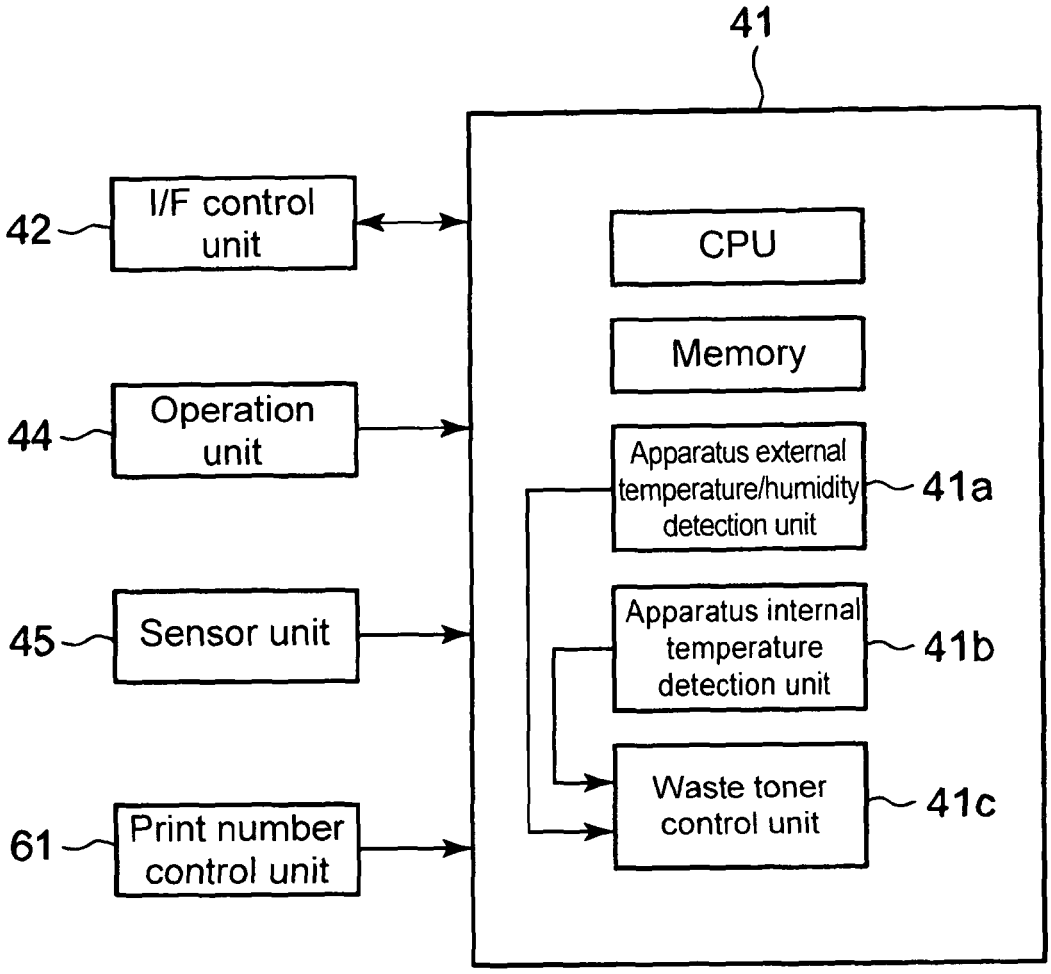
FIG. 5 is a block diagram showing a print control unit of the image forming apparatus according to the first embodiment of the present invention.

FIG. 5 is a block diagram showing the print control unit 41 of the image forming apparatus according to the first embodiment of the present invention. As shown in FIG. 5, the print control unit 41 includes an apparatus external temperature/humidity detection unit 41*a*; an apparatus internal temperature detection unit 41*b*; and a waste toner control unit 41*c* (described later).

An operation of the image forming apparatus 1 will be explained next. First, a printing operation of the image forming apparatus 1 will be explained with reference to FIGS. 1 and 2.

When the image forming apparatus 1 receives a print direction from the host device, the hoping roller 13 is driven to transport the recording medium P in the charge roller 12 to the transportation path 14, so that the recording medium P is transported toward the image forming unit 2*a* through the transportation path 14. The charge roller 12 charges the surface of the photosensitive member 3, and the LED head 22 irradiates the surface of the photosensitive member 3 according to the image data, so that the static latent image is formed on the surface of the photosensitive member 3. The developing roller 23 of the developing device 25 attaches toner to the static latent image to form the toner image, and the transfer roller 5 transfers the toner image to the recording medium P thus transported.

When the image forming apparatus 1 performs a color printing operation, the toner image is transferred in each of the image forming units 2*a*, 2*b*, 2*c*, and 2*d*. After the toner image is transferred to the recording medium P, the transfer belt 4 transports the recording medium P to the fixing device 17, so that the fixing device 17 fixes the toner image to the recording medium P through heat. After the fixing device 17 fixes the toner image to the recording medium P, the transportation rollers 18 and 19 discharge the recording medium P to the discharge unit 20, thereby completing the printing operation.

An operation of the developing device 25 will be explained in detail next. After the toner image is transferred from the photosensitive member 3 to the recording medium P, the cleaning blade 24 scrapes off toner remaining on the photosensitive member 3 (refer to FIG. 2). In the image forming apparatus 1, the developing device 25 develops with a one-component developing method using the toner 30 as one-component developer.

As described above, the shutter with an opening portion is disposed at the lower portion of the toner cartridge 31. When the shutter opens, that is, the opening portion opens, the toner 30 in the toner cartridge 31 drops into the developing device 25 for a specific amount through the opening portion, thereby supplying the toner 30 to the developing device 25.

In the developing device 25, the stirring member 28 rotates and stirs the toner 30, and the toner transportation member 29 transports the toner 30 to the supply roller 26. The supply roller 26 slides against the developing roller 23, and rotates in a direction same as that of the developing roller 23 at a circumferential speed having a specific difference from that of the developing roller 23. Accordingly, the supply roller 26 transports the toner 30 to the developing roller 23, and scraps off toner remaining on an outer circumferential surface of the developing roller 23.

When the developing roller 23 rotates, the toner 30 on the developing roller 23 is transported to the developing blade 27, so that the developing blade 27 regulates a thickness of a toner layer. Afterward, the toner 30 is transported to a developing area facing the photosensitive member 3, so that the toner 30 is attracted to the static latent image formed on the surface of the photosensitive member 3 through an electrostatic force, and moves to the photosensitive member 3, thereby forming the toner image on the photosensitive member 3.

When the photosensitive member 3 rotates and the toner image moves to a position facing the transfer roller 5, the transfer roller 5 transfers the toner image to the recording medium P. Afterward, as described above, the fixing device 17 fixes the toner image to the recording medium P through heat, and the recording medium P is discharged. After the transfer roller 5 transfers the toner image to the recording medium P, the cleaning blade 24 cleans toner remaining on the surface of the photosensitive member 3, thereby starting a next printing operation.

An experiment of determining a temperature dependence of filming of the image forming apparatus 1 will be explained next. In the experiment, the cleaning blade 24 having the properties shown in Table 1 was pressed against the photosensitive member 3 at an angle of 15.01 degree with a pressing force of 16.4 kg/cm.

Further, in the experiment, 2,000 of an A4 size sheets were continuously printed on one side surfaces thereof while transporting the sheets in a lateral direction thereof and stopping the printing operation every three sheets. With the arrangement described above, the filming on the photosensitive member 3 was evaluated. Note that the angle and the pressing force of the cleaning blade 24 pressed against the photosensitive member 3 were calculated at 24° C.

In a conventional mage forming apparatus, it is possible to prevent the filming through discarding toner and a substance attached to a photosensitive member. When toner is discarded, a specific toner image is formed on the photosensitive member, and a cleaning blade scrapes off toner without transferring the specific toner image to a recording medium (in an un-transferred state).

In the embodiment, similar to the conventional image forming apparatus, when toner is discarded, a specific toner image is formed on the photosensitive member 3, and the cleaning blade 24 scrapes off toner without transferring the specific toner image to the recording medium P (in an un-transferred state).

Table 2 to Table 5 show results of the experiment of determining the temperature dependence of the filming of the image forming apparatus 1. In Table 2 to Table 4, the filming was evaluated according to the number of the sheets thus printed without discarding toner. In Table 5, the filming was evaluated according to the number of the sheets thus printed with discarding toner.

In Table 2 to Table 5, "good" represents that the filming was not observed; "fair" represents that the filming was slightly observed on the photosensitive member 3 and the filming did not affect on a printed image; and "poor" represents that the filming was slightly observed on the photosensitive member 3 and the filming deteriorated a printed image. In the experiment, as the printed image, a solid image (an image with 100% density, so-called solid pattern) was printed on one sheet in every five hundred sheets, and the solid image was evaluated.

TABLE 2

| | Internal temperature | Image forming unit 2a | Image forming unit 2b | Image forming unit 2c | Image forming unit 2d |
|---|---|---|---|---|---|
| 0 | 33° C. | Good | Good | Good | Good |
| 500 | 39° C. | Good | Good | Fair | Fair |
| 1000 | 46° C. | Good | Fair | Fair | Poor |
| 1500 | 46° C. | Fair | Poor | Poor | Poor |
| 2000 | 47° C. | Poor | Poor | Poor | Poor |

TABLE 3

| | Internal temperature | Image forming unit 2a | Image forming unit 2b | Image forming unit 2c | Image forming unit 2d |
|---|---|---|---|---|---|
| 0 | 18° C. | Good | Good | Good | Good |
| 500 | 25° C. | Good | Good | Good | Fair |
| 1000 | 29° C. | Good | Good | Fair | Poor |
| 1500 | 33° C. | Good | Fair | Fair | Poor |
| 2000 | 36° C. | Good | Poor | Poor | Poor |

TABLE 4

| | Internal temperature | Image forming unit 2a | Image forming unit 2b | Image forming unit 2c | Image forming unit 2d |
|---|---|---|---|---|---|
| 0 | 18° C. | Good | Good | Good | Good |
| 500 | 25° C. | Good | Good | Good | Good |
| 1000 | 29° C. | Good | Good | Good | Good |
| 1500 | 33° C. | Good | Good | Good | Fair |
| 2000 | 36° C. | Good | Good | Fair | Poor |

TABLE 5

| | Internal temperature | Image forming unit 2a | Image forming unit 2b | Image forming unit 2c | Image forming unit 2d |
|---|---|---|---|---|---|
| 0 | 33° C. | Good | Good | Good | Good |
| 500 | 39° C. | Good | Good | Good | Good |
| 1000 | 46° C. | Good | Good | Good | Good |
| 1500 | 46° C. | Good | Good | Good | Good |
| 2000 | 47° C. | Good | Good | Good | Good |

TABLE 6

| | Internal temperature | Image forming unit 2a | Image forming unit 2b | Image forming unit 2c | Image forming unit 2d |
|---|---|---|---|---|---|
| 0 | 18° C. | Good | Good | Good | Good |
| 500 | 25° C. | Good | Good | Good | Good |
| 1000 | 29° C. | Good | Good | Good | Good |
| 1500 | 33° C. | Good | Good | Good | Good |
| 2000 | 36° C. | Good | Good | Good | Good |

TABLE 7

| | Internal temperature | Image forming unit 2a | Image forming unit 2b | Image forming unit 2c | Image forming unit 2d |
|---|---|---|---|---|---|
| 0 | 18° C. | Good | Good | Good | Good |
| 500 | 25° C. | Good | Good | Good | Good |
| 1000 | 29° C. | Good | Good | Good | Good |
| 1500 | 33° C. | Good | Good | Good | Good |
| 2000 | 36° C. | Good | Good | Good | Good |

Table 2 shows the results of the experiment conducted at an external environmental temperature of 25° C., a fixing temperature of 170° C., and an absolute water vapor amount of 13 g/m$^3$ without discarding toner. Table 3 shows the results of the experiment conducted at an external environmental temperature of 10° C., a fixing temperature of 170° C., and an absolute water vapor amount of 2.5 g/m$^3$ without discarding toner. Table 4 shows the results of the experiment conducted at an external environmental temperature of 10° C., a fixing temperature of 170° C., and an absolute water vapor amount of 13 g/m$^3$ without discarding toner.

Table 5 shows the results of the experiment conducted at an external environmental temperature of 25° C., a fixing temperature of 170° C., and an absolute water vapor amount of 13 g/m$^3$ with discarding toner at every five hundred sheets in each of the image forming units 2*a*, 2*b*, 2*c*, and 2*d*. Table 6 shows the results of the experiment conducted at an external environmental temperature of 10° C., a fixing temperature of 170° C., and an absolute water vapor amount of 2.5 g/m$^3$ with discarding toner at every five hundred sheets in each of the image forming units 2*a*, 2*b*, 2*c*, and 2*d*. Table 7 shows the results of the experiment conducted at an external environmental temperature of 10° C., a fixing temperature of 170° C., and an absolute water vapor amount of 14.2 g/m$^3$ with discarding toner at every five hundred sheets in each of the image forming units 2*a*, 2*b*, 2*c*, and 2*d*.

In the experiment, the absolute water vapor amount was determined with the flowing equation using the external temperature and humidity of the image forming apparatus 1.

Absolute water vapor amount=saturated water vapor amount×(humidity/100) =(0.0225×temperature×temperature+0.1568×temperature+5.205)×(humidity/100)

As shown in Table 2 to Table 4, even through the absolute water vapor amount was substantially the same, when the external environmental temperature was different, the internal temperature was different and the result of the filming was different. Further, even through the external environmental temperature was substantially the same, when the absolute water vapor amount was different, the result of the filming was different.

Further, as shown in Table 5 to Table 7, when toner was discarded at every five hundred sheets in each of the image forming units 2*a*, 2*b*, 2*c*, and 2*d*, the filming was not observed.

In summary, the filming tends to occur when the humidity is lower. Further, the filming tends to occur in the image forming apparatus near the fixing device 17 (due to a higher internal temperature). When toner is discarded, the filming does not occur. According to a relationship between the internal temperature and the absolute water vapor amount, it is possible to prevent the filming through discarding toner only in the image forming unit where the filming tends to occur, instead of discarding toner in all of the image forming units 2*a*, 2*b*, 2*c*, and 2*d*.

When a blank printing is performed under a low humidity condition, toner is charged with a large amount of charges. Accordingly, toner or an external additive tends to stick to the photosensitive member 3, or toner is easy to melt with heat of the fixing device 17 and stick to the photosensitive member 3, thereby causing the filming.

When an external additive is accumulated on the edge of the cleaning blade 24, the external additive tends to stick to the photosensitive member 3 due to heat of the fixing device 17, frictional heat between the cleaning blade 24 and the photosensitive member 3, and pressure. When toner is discarded, toner absorb the external additive accumulated on the edge of the cleaning blade 24, and toner and the external additive are discarded together, thereby preventing the filming.

In the embodiment, it is determined whether toner is discarded according to the absolute water vapor amount and the internal temperature of the image forming apparatus 1. It is difficult to accurately measure an internal humidity of the image forming apparatus 1 due to a variance in the internal temperature thereof. Further, it can be assumed that the absolute water vapor amount is the same inside and outside the image forming apparatus 1. Accordingly, the absolute water vapor amount outside the image forming apparatus 1 is used as a parameter.

In the embodiment, in the image forming units 2*a*, 2*b*, 2*c*, and 2*d*, it is determined whether toner is discarded according to Table 8. In Table 8, the temperature sensor 8 determines an internal temperature T (° C.). Further, the temperature humidity sensor 9 determines an absolute water vapor amount W (g/m$^3$) according to the equation described above.

TABLE 8

| | 0 ≦ W < 5 | 5 ≦ W < 10 | 10 ≦ W < 15 | W > 15 |
|---|---|---|---|---|
| T < 20 | 0 | 0 | 0 | 0 |
| 20 ≦ T < 25 | 1 | 0 | 0 | 0 |
| 25 ≦ T < 30 | 2 | 1 | 0 | 0 |
| 30 ≦ T < 35 | 3 | 2 | 1 | 0 |
| 35 ≦ T < 40 | 3 | 3 | 2 | 1 |
| 40 ≦ T < 45 | 4 | 3 | 3 | 3 |
| T ≧ 45 | 4 | 4 | 4 | 4 |

In Table 8, when there is no image forming unit in which toner is discarded, the result shows "0". When there is one image forming unit, i.e., the image forming unit 2*d* situated closest to the fixing device 17, in which toner is discarded, the result shows "1". When there is two image forming units, i.e., the image forming units 2*c* and 2*d* situated close to the fixing device 17, in which toner is discarded, the result shows "2". When there is three image forming units, i.e., the image forming units 2*b*, 2*c*, and 2*d* situated close to the fixing device 17, in which toner is discarded, the result shows "3". When toner is discarded in all of the image forming units 2*a*, 2*b*, 2*c*, and 2*d*, the result shows "4".

In the embodiment, in the image forming units 2*a*, 2*b*, 2*c*, and 2*d*, it is determined whether toner is discarded at a specific timing (described later). More specifically, the print control unit 41 (refer to FIG. 5) controls the waste toner control unit 41*c* at the specific timing to determine whether toner is discarded.

In particular, the apparatus external temperature/humidity detection unit 41*a* detects a temperature and a humidity outside the image forming apparatus 1 according to a signal from the temperature humidity sensor 9 disposed in the sensor unit 45. Then, the apparatus external temperature/humidity detection unit 41*a* sends a detection signal to the waste toner control unit 41*c*. Further, the apparatus internal temperature detection unit 41*b* detects a temperature inside the image forming apparatus 1 according to a signal from the temperature sensor 8 disposed in the sensor unit 45. Then, the apparatus internal temperature detection unit 41*b* sends a detection signal to the waste toner control unit 41*c*. Afterward, the waste toner control unit 41*c* determines whether toner is discarded according to the detection signals thus received.

When toner is discarded, the head drive control unit 46 and the photosensitive member drive control unit 49 (refer to FIG. 4) form an image on the photosensitive member 3, thereby discarding toner. As described above, in discarding toner, the specific toner image is formed on the photosensitive member 3, and the cleaning blade 24 scrapes off toner without transferring the specific toner image to the recording medium P (in the un-transferred state).

In the embodiment, it is determined whether toner is discarded at the specific timing including when the image forming apparatus 1 is turned on; when the cover is opened and closed, so that the image forming units 2*a*, 2*b*, 2*c*, and 2*d* of the image forming apparatus 1 are replaced; when the printing operation starts; when an image density is corrected; or when a specific number of sheets are printed.

In the embodiment, when the print control unit 41 (refer to FIG. 4) detects that an operator turns on a power switch of the operation unit 44, the print control unit 41 determines that the image forming apparatus 1 is turned on. When the print control unit 41 receives an opening/closing detection signal of the cover opening/closing sensor 45*b*, the print control unit 41 determines that the cover is opened and closed. When the print control unit 41 receives a printing operation start signal or a density correction signal (not shown), the print control unit 41 determines that the printing operation starts or the image density is corrected. Further, the print control unit 41 receives a number of printed sheets of the image forming units 2*a*, 2*b*, 2*c*, and 2*d* from the print number counter unit 61, the print control unit 41 determines that the specific number of sheets are printed.

In the embodiment, when the image forming apparatus 1 is turned on, or the cover is opened and closed, or the image density is corrected, it is possible to discard a large amount of toner due to leeway. When the printing operation starts, toner is discarded without slowing down a printing speed, thereby discarding a relatively small amount of toner as compared with that when the image forming apparatus 1 is turned on.

When the image forming apparatus 1 is turned on, or the cover is opened and closed, it takes a few seconds until the fixing device 17 generating heat is stabilized, thereby making it possible to discard toner at an arbitrary timing. When the printing operation starts and the image forming apparatus 1 receives a print direction, the photosensitive member 3 starts rotating. At this time, it takes a few hundreds of milliseconds until the recording medium P reaches the photosensitive member 3, thereby making it possible to discard toner during the period of time. When the image density is corrected, the discarded toner pattern is formed after a density correction pattern is formed.

In the embodiment, upon discarding toner at the specific timing, an amount of toner to be discarded, i.e., a number of dots of the discarded toner pattern will be explained next. It is assumed that the supply roller 26 has a resolution of 600 DPI, and the discarded toner pattern is a whole printable area luminescence "1010" (a whole area 50% pattern in which dots of LEDs at alternated locations emit light) in consideration of a toner consumption amount and the likes.

When the image forming apparatus 1 is turned on, or the cover is opened and closed, the discarded toner pattern has a dot number of 3564 (297 mm) in a main scanning direction and a line number of 4096 (172 mm) in a sub-scanning direction.

When the printing operation starts, the discarded toner pattern has a dot number of 3564 (297 mm) in the main scanning direction and a line number of 682 (28.6 mm) in the sub-scanning direction.

When the image density is corrected, the discarded toner pattern has a dot number of 3564 (297 mm) in the main scanning direction and a line number of 4096 (172 mm) in the sub-scanning direction.

When five hundred sheets with the A4 size are printed, the discarded toner pattern has a dot number of 3564 (297 mm) in the main scanning direction and a line number of 4096 (172 mm) in the sub-scanning direction.

In the embodiment, it is preferred that the discarded toner pattern has a length in the sub-scanning direction corresponding to a circumference of the photosensitive member 3. For example, when the photosensitive member 3 has an outer diameter of 30 mm, it is preferred that the discarded toner pattern has a length of 94.2 mm in the sub-scanning direction. Toner is discarded in all of the image forming units 2*a*, 2*b*, 2*c*, and 2*d* every 2,000 sheets. It is not limited o 2,000 sheets, and toner may not be forcibly discarded.

As described above, in the embodiment, it is determined whether toner is discarded at the specific timing (described later) in which of the image forming units 2*a*, 2*b*, 2*c*, and 2*d* according to Table 8, the temperature and the humidity outside the image forming apparatus 1, and the temperature inside the image forming apparatus 1. Accordingly, it is possible to discard toner only in the image forming unit where the filming tends to occur, instead of discarding toner in all of the image forming units 2*a*, 2*b*, 2*c*, and 2*d*. As a result, it is possible to reduce the amount of toner to be discarded.

Second Embodiment

Figure 6:
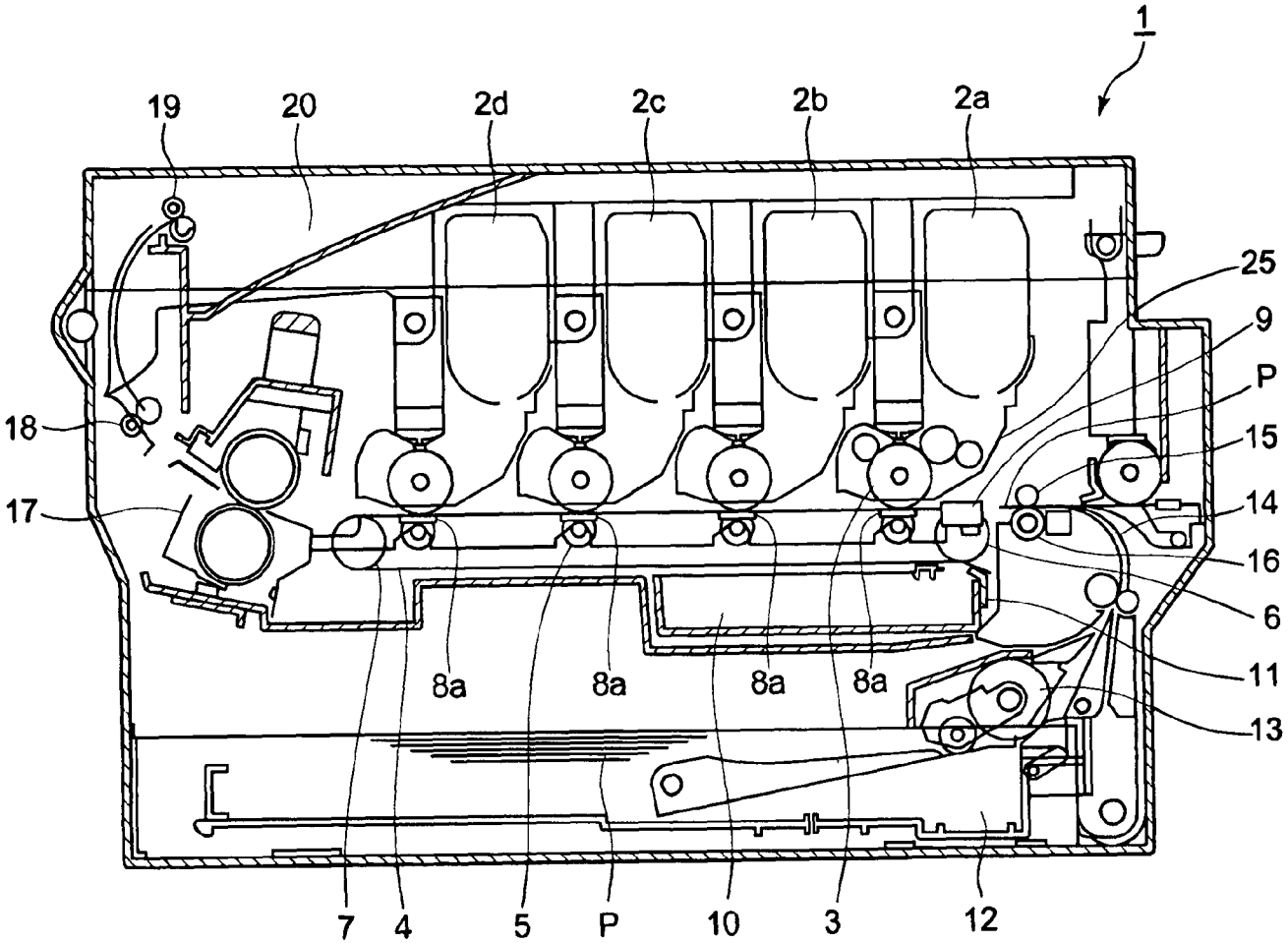
FIG. 6 is a schematic view showing an image forming apparatus according to a second embodiment of the present invention.

A second embodiment of the present invention will be explained next. In the second embodiment, the temperature sensor 8 is disposed at a position different from that in the first embodiment. FIG. 6 is a schematic view showing the image forming apparatus 1 according to the second embodiment of the present invention.

In the second embodiment, the image forming units 2*a*, 2*b*, 2*c*, and 2*d*, the toner collection unit, the control unit of the image forming apparatus 1, and the print control unit 41 have configurations similar to those in the first embodiment (refer to FIGS. 2 to 5), and explanations thereof are omitted.

As shown in FIG. 6, the image forming apparatus 1 includes image forming units 2*a*, 2*b*, 2*c*, and 2*d* arranged in a lateral direction. The image forming units 2*a*, 2*b*, 2*c*, and 2*d* store toner in different colors, thereby making it possible to form a color image. More specifically, the image forming unit 2*a* stores toner in black; the image forming unit 2*b* stores toner in yellow; the image forming unit 2*c* stores toner in magenta; and the image forming unit 2*d* stores toner in cyan.

In the embodiment, the housing of the image forming apparatus 1 includes the cover disposed at the upper portion thereof to be capable of opening and closing, so that the image forming units 2*a*, 2*b*, 2*c*, and 2*d* can be replaced. Each of the image forming units 2*a*, 2*b*, 2*c*, and 2*d* includes the photosensitive member 3 to be rotatable at a specific rotational speed. A surface of the photosensitive member 3 is capable of accumulating charges, and also capable of releasing charges upon exposure. The photosensitive member 3 is formed of, for example, an organic photosensitive material.

In the embodiment, the transfer belt 4 and the transfer rollers 5 are disposed as the transfer members under the photosensitive members 3. The transfer belt 4 is placed between the idle roller 6 and the drive roller 7 to be rotatable, so that the drive roller 7 drives the transfer belt 4 to rotate. The transfer roller 5 is provided for transferring the toner image on the photosensitive member 3 to the recording medium P, and is disposed under each of the photosensitive members 3. A power source (not shown) applies a voltage to the transfer belt 4 and the transfer rollers 5.

In the embodiment, a temperature sensor 8*a* is disposed in each of the image forming units 2*a*, 2*b*, 2*c*, and 2*d* to contact with a non-printing portion of the photosensitive member 3 for detecting a temperature of each of the developing device 25 in the image forming apparatus 1. The temperature humidity sensor 9 is disposed near the idle roller 6 at the side portion of the image forming apparatus 1 for detecting an external temperature and an external humidity of the image forming apparatus 1. The temperature sensor 8*a* may be 103ET-1 (a product of Ishizuka Electronics Corporation), and the temperature humidity sensor 9 may be MSM3103J375J and HIS-05-N (products of Hokuriku Electric Industry Co., Ltd.).

In the embodiment, the toner collection container 10 is disposed under the transfer belt 4. When toner attaches to the transfer belt 4 due to a trouble in transporting a sheet, the transfer belt cleaning blade 11 remove toner from the transfer belt 4, so that toner is collected in the toner collection container 10.

In the embodiment, the medium tray 12 is disposed at the lower portion of the image forming apparatus 1 for storing the recording medium P. The hoping roller 13 picks up and transports the recording medium P to the transportation path 14 one by one. The register roller 15 or the pressure roller is provided in the transportation path 14 for transporting the recording medium P to the transfer belt 4 without skew. Further, the register roller 16 or the feed roller is provided in the transportation path 14 for transporting the recording medium P to the transfer belt 4.

In the embodiment, the fixing device 17 is disposed on the downstream side of the drive roller 7 in the direction that the recording medium P is transported. The fixing device 17 fixes toner transferred on the recording medium P to the recording medium P through heat. The discharge rollers 18 and 19 are disposed on the downstream side of the fixing device 17 in the direction that the recording medium P is transported. The discharge rollers 18 and 19 discharge the recording medium P to the discharge unit 20 after the fixing device 17 fixes toner.

As described in the first embodiment, the filming occurs depending on the internal temperature and the absolute water vapor amount. In the second embodiment, the temperature sensor 8*a* is disposed in each of the image forming units 2*a*, 2*b*, 2*c*, and 2*d* for measuring the temperature of the developing device 25.

In the embodiment, in the image forming units 2*a*, 2*b*, 2*c*, and 2*d* each having the temperature sensor 8*a*, it is determined whether toner is discarded according to Table 9.

TABLE 9

| | 0 ≦ W < 5 | 5 ≦ W < 10 | 10 ≦ W < 15 | W > 15 |
|---|---|---|---|---|
| T < 20 | 0 | 0 | 0 | 0 |
| 20 ≦ T < 25 | 1 | 0 | 0 | 0 |
| 25 ≦ T < 30 | 1 | 0 | 0 | 0 |
| 30 ≦ T < 35 | 1 | 1 | 0 | 0 |
| 35 ≦ T < 40 | 1 | 1 | 0 | 0 |
| 40 ≦ T < 45 | 1 | 1 | 1 | 0 |
| T ≧ 45 | 1 | 1 | 1 | 1 |

In Table 9, the temperature sensor 8*a* determines the internal temperature T (° C.). Further, similar to the first embodiment, the absolute water vapor amount W (g/m$^3$) is determined according to the following equation using the detection results of the temperature humidity sensor 9.

Absolute water vapor amount=saturated water vapor amount×(humidity/100) =(0.0225×temperature×temperature+0.1568×temperature+5.205)×(humidity/100)

In Table 9, when any of the image forming units 2*a*, 2*b*, 2*c*, and 2*d* does not discard toner, the result shows "0". When at least one of the image forming units 2*a*, 2*b*, 2*c*, and 2*d* discards toner, the result shows "1".

Table 10 shows a change in a temperature in the image forming units 2*a*, 2*b*, 2*c*, and 2*d* when a specific number of the A-4 sheets are continuously printed (the external temperature of 25° C., the fixing temperature of 170° C.). As described above, among the image forming units 2*a*, 2*b*, 2*c*, and 2*d*, the image forming unit closer to the fixing device 17 tends to receive greater influence of heat generated in the fixing device 17.

TABLE 10

| | Image forming unit 2a | Image forming unit 2b | Image forming unit 2c | Image forming unit 2d |
|---|---|---|---|---|
| 0 | 26° C. | 27° C. | 27° C. | 33° C. |
| 500 | 29° C. | 34° C. | 36° C. | 38° C. |
| 1000 | 33° C. | 38° C. | 39° C. | 43° C. |
| 1500 | 39° C. | 40° C. | 42° C. | 45° C. |
| 2000 | 40° C. | 42° C. | 44° C. | 46° C. |

In the embodiment, when five hundred A4 sheets are printed, based on Table 10 showing the relationship between the temperatures of the image forming units 2*a*, 2*b*, 2*c*, and 2*d* and the absolute water vapor amount outside the image forming apparatus 1, it is determined whether toner is discarded in the image forming units 2*a*, 2*b*, 2*c*, and 2*d* according to Table 9. For example, when the external temperature of 25° C., the fixing temperature is 170° C., and the absolute water vapor amount is 13 g/m$^3$, a relationship between a number of A4 sheets printed continuously and discarding toner is shown in Table 11.

TABLE 11

| | Image forming unit 2a | Image forming unit 2b | Image forming unit 2c | Image forming unit 2d |
|---|---|---|---|---|
| 0 | No discarding | No discarding | No discarding | No discarding |
| 500 | No discarding | No discarding | Discarding | Discarding |
| 1000 | No discarding | Discarding | Discarding | Discarding |
| 1500 | Discarding | Discarding | Discarding | Discarding |
| 2000 | Discarding | Discarding | Discarding | Discarding |

For example, when five hundred A4 sheets are printed, according to Table 10, the internal temperature of the image forming unit 2*b* is 34° C., and the internal temperature of the image forming unit 2*c* is 36° C. Accordingly, when the absolute water vapor amount is 13 g/m$^3$, according to Table 9, it is determined that toner is not discarded in the image forming unit 2*b*, and toner is discarded in the image forming unit 2*b*.

In the second embodiment, similar to the first embodiment, it is determined whether toner is discarded in the image forming units 2*a*, 2*b*, 2*c*, and 2*d* at a specific timing. More specifically, the print control unit 41 (refer to FIG. 5) controls the waste toner control unit 41*c* at the specific timing to determine whether toner is discarded.

In particular, the apparatus external temperature/humidity detection unit 41*a* detects the temperature and the humidity outside the image forming apparatus 1 according to a signal from the temperature humidity sensor 9 disposed in the sensor unit 45. Then, the apparatus external temperature/humidity detection unit 41*a* sends the detection signal to the waste toner control unit 41*c*. Further, the apparatus internal temperature detection unit 41*b* detects the temperature of the developing device 25 according. to a signal from the temperature sensor 8*a* disposed in the sensor unit 45. Then, the apparatus internal temperature detection unit 41*b* sends a detection signal to the waste toner control unit 41*c*. Afterward, the waste toner control unit 41*c* determines whether toner is discarded according to the detection signals thus received.

In the embodiment, the temperature of each of the developing devices 25 is measured. Accordingly, it is possible to accurately detect the temperatures in the image forming units 2*a*, 2*b*, 2*c*, and 2*d*. As a result, according to the absolute water vapor amount and the temperatures in the image forming units 2*a*, 2*b*, 2*c*, and 2*d*, it is possible to discard toner depending on the tendency of the filming according to the distance from the fixing device 17.

Note that toner in different colors tends to have different properties, thereby causing the filming at different temperature and humidity. In the embodiment, it is possible to determine whether toner is discarded in each of the developing devices 25. Accordingly, it is possible to discard toner only in the developing device 25 of a color necessary for discarding toner according to a property of toner in the color at a specific temperature.

In the embodiment, toner is discarded in all of the image forming units 2*a*, 2*b*, 2*c*, and 2*d* every 2,000 sheets. It is not limited o 2,000 sheets, and toner may not be forcibly discarded.

Third Embodiment

Figure 7:
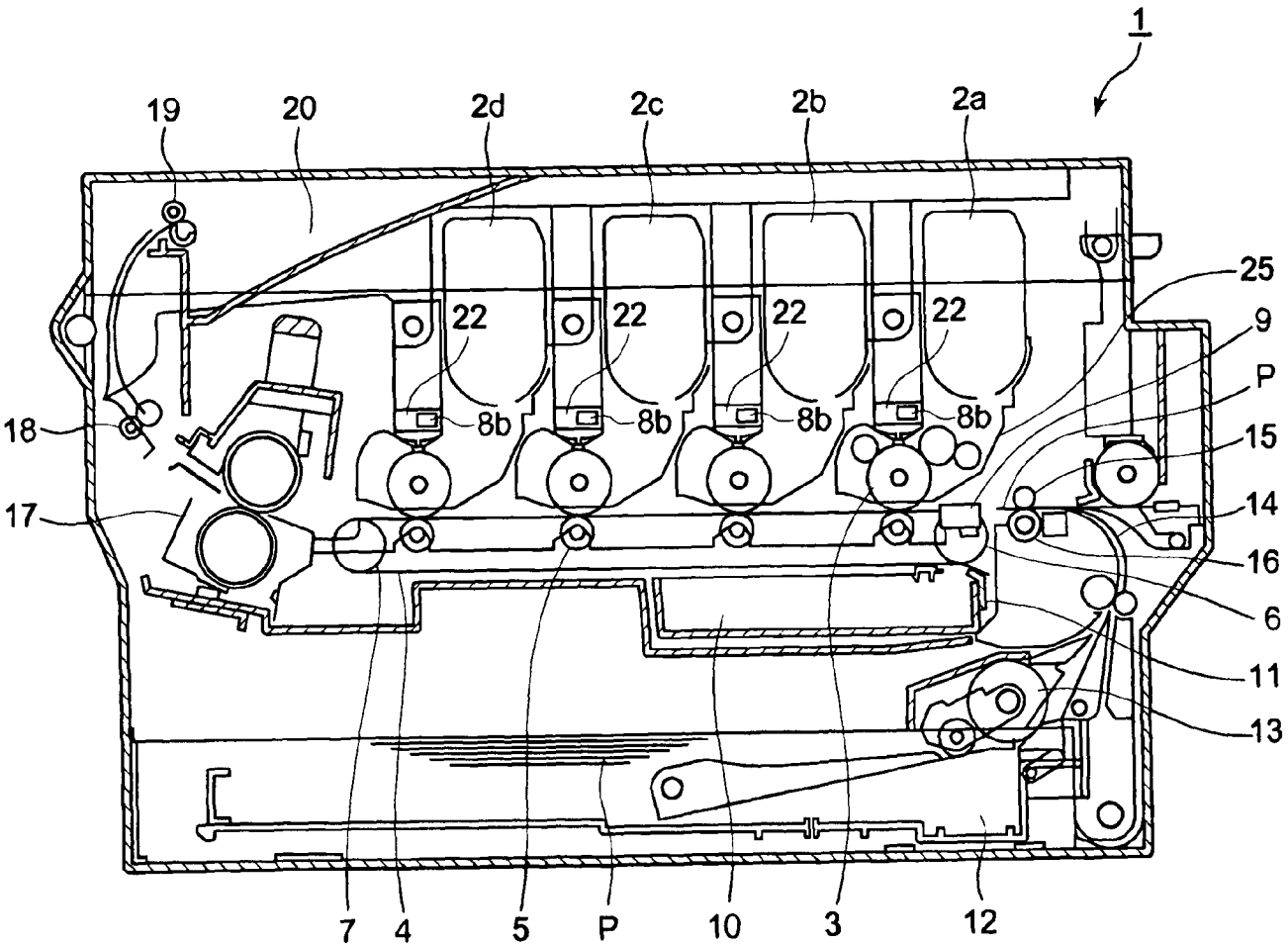
FIG. 7 is a schematic view showing an image forming apparatus according to a third embodiment of the present invention.

A third embodiment of the present invention will be explained next. In the third embodiment, the temperature sensor 8*a* is disposed at a position different from that in the second embodiment. FIG. 7 is a schematic view showing the image forming apparatus 1 according to the third embodiment of the present invention.

In the third embodiment, the image forming units 2*a*, 2*b*, 2*c*, and 2*d*, the toner collection unit, the control unit of the image forming apparatus 1, and the print control unit 41 have configurations similar to those in the first embodiment (refer to FIGS. 2 to 5), and explanations thereof are omitted.

As shown in FIG. 7, the image forming apparatus 1 includes image forming units 2*a*, 2*b*, 2*c*, and 2*d* arranged in a lateral direction. The image forming units 2*a*, 2*b*, 2*c*, and 2*d* store toner in different colors, thereby making it possible to form a color image. More specifically, the image forming unit 2*a* stores toner in black; the image forming unit 2*b* stores toner in yellow; the image forming unit 2*c* stores toner in magenta; and the image forming unit 2*d* stores toner in cyan.

In the embodiment, the housing of the image forming apparatus 1 includes the cover disposed at the upper portion thereof to be capable of opening and closing, so that the image forming units 2*a*, 2*b*, 2*c*, and 2*d* can be replaced. Each of the image forming units 2*a*, 2*b*, 2*c*, and 2*d* includes the photosensitive member 3 to be rotatable at a specific rotational speed. A surface of the photosensitive member 3 is capable of accumulating charges, and also capable of releasing charges upon exposure. The photosensitive member 3 is formed of, for example, an organic photosensitive material.

In the embodiment, the transfer belt 4 and the transfer rollers 5 are disposed as the transfer members under the photosensitive members 3. The transfer belt 4 is placed between the idle roller 6 and the drive roller 7 to be rotatable, so that the drive roller 7 drives the transfer belt 4 to rotate. The transfer roller 5 is provided for transferring the toner image on the photosensitive member 3 to the recording medium P, and is disposed under each of the photosensitive members 3. A power source (not shown) applies a voltage to the transfer belt 4 and the transfer rollers 5.

In the embodiment, the LED heads 22 form the static latent images on the photosensitive member 3. A temperature sensor 8*b* is disposed on each of the LED heads 22 for detecting a temperature of each of the developing device 25 in the image forming apparatus 1 without contact. The temperature humidity sensor 9 is disposed near the idle roller 6 at the side portion of the image forming apparatus 1 for detecting an external temperature and an external humidity of the image forming apparatus 1. The temperature sensor 8*b* may be 103ET-1 (a product of Ishizuka Electronics Corporation), and the temperature humidity sensor 9 may be MSM3103J375J and HIS-05-N (products of Hokuriku Electric Industry Co., Ltd.).

In the embodiment, the toner collection container 10 is disposed under the transfer belt 4. When toner attaches to the transfer belt 4 due to a trouble in transporting a sheet, the transfer belt cleaning blade 11 remove toner from the transfer belt 4, so that toner is collected in the toner collection container 10.

In the embodiment, the medium tray 12 is disposed at the lower portion of the image forming apparatus 1 for storing the recording medium P. The hoping roller 13 picks up and transports the recording medium P to the transportation path 14 one by one. The register roller 15 or the pressure roller is provided in the transportation path 14 for transporting the recording medium P to the transfer belt 4 without skew. Further, the register roller 16 or the feed roller is provided in the transportation path 14 for transporting the recording medium P to the transfer belt 4.

In the embodiment, the fixing device 17 is disposed on the downstream side of the drive roller 7 in the direction that the recording medium P is transported. The fixing device 17 fixes toner transferred on the recording medium P to the recording medium P through heat. The discharge rollers 18 and 19 are disposed on the downstream side of the fixing device 17 in the direction that the recording medium P is transported. The discharge rollers 18 and 19 discharge the recording medium P to the discharge unit 20 after the fixing device 17 fixes toner.

In the embodiment, the temperature sensor 8*b* detects the temperature in each of the developing devices 25, and it is determined whether toner is discarded according to Table 9. Similar to the second embodiment, when five hundred A4 sheets are printed, based on Table 10 showing the relationship between the temperatures of the image forming units 2*a*, 2*b*, 2*c*, and 2*d* and the absolute water vapor amount outside the image forming apparatus 1, it is determined whether toner is discarded in the image forming units 2*a*, 2*b*, 2*c*, and 2*d* according to Table 9.

In the third embodiment, similar to the first embodiment, it is determined whether toner is discarded in the image forming units 2*a*, 2*b*, 2*c*, and 2*d* at a specific timing. More specifically, the print control unit 41 (refer to FIG. 5) controls the waste toner control unit 41*c* at the specific timing to determine whether toner is discarded.

In particular, the apparatus external temperature/humidity detection unit 41*a* detects the temperature and the humidity outside the image forming apparatus 1 according to a signal from the temperature humidity sensor 9 disposed in the sensor unit 45. Then, the apparatus external temperature/humidity detection unit 41*a* sends the detection signal to the waste toner control unit 41*c*. Further, the apparatus internal temperature detection unit 41*b* detects the temperature of the developing device 25 according to a signal from the temperature sensor 8*b* disposed in the sensor unit 45. Then, the apparatus internal temperature detection unit 41*b* sends a detection signal to the waste toner control unit 41*c*. Afterward, the waste toner control unit 41*c* determines whether toner is discarded according to the detection signals thus received.

In the embodiment, the temperature of each of the developing devices 25 is measured. Accordingly, it is possible to accurately detect the temperatures in the image forming units 2*a*, 2*b*, 2*c*, and 2*d*. As a result, according to the absolute water vapor amount and the temperatures in the image forming units 2*a*, 2*b*, 2*c*, and 2*d*, it is possible to discard toner depending on the tendency of the filming according to the distance from the fixing device 17.

In the embodiment, the temperature sensor 8*b* detects the temperature in each of the developing devices 25 without contact, thereby preventing the photosensitive member 3 from being damaged. In general, it is difficult to measure a temperature with a small variance due to toner attached to the temperature sensor, a variance in a contact position or a contact area upon replacing a developing device. In the embodiment, the temperature sensor 8*b* is disposed in the LED head 24 as the exposure device. Accordingly, it is possible to measure the temperature at a constant position without toner attached to the temperature sensor 8*b*, thereby making it possible to accurately measure the temperature.

In the embodiments described above, the image forming apparatus 1 forms an image through a one-component developer method, and may form an image through a two-component developer method using toner and a carrier.

The disclosure of Japanese Patent Application No. 2007-294208, filed on Nov. 13, 2007, is incorporated in the application by reference.

While the invention has been explained with reference to the specific embodiments of the invention, the explanation is illustrative and the invention is limited only by the appended claims.

What is claimed is:

1. An image forming apparatus comprising:

a plurality of image forming units each having an image supporting member, a developer supporting member, and a cleaning member disposed to face the image supporting member for cleaning developer on the image supporting member;

a transfer device for transferring a developer image formed on the image supporting member to a medium;

a fixing device for fixing the developer image to the medium through heat;

a first detection unit for detecting a first physical value of an external environment of the image forming apparatus;

a second detection unit for detecting a second physical value of an internal environment of the image forming apparatus; and a control unit for determining whether at least one of the image forming units performs a developer discard mode in which the developer is discarded from the developer supporting member to the image supporting member according to the first physical value, the second physical value, and a distance between the at least one of the image forming units and the fixing device.

2. The image forming apparatus according to claim 1, wherein said second detection unit is disposed in each of the image forming units.

3. The image forming apparatus according to claim 1, wherein said second detection unit is formed of a non-contact type sensor.

4. The image forming apparatus according to claim 1, wherein said first detection unit is adopted to detect the first physical value including an absolute water vapor amount determined from a temperature outside the image forming apparatus and a relative humidity.

5. The image forming apparatus according to claim 1, wherein said second detection unit is adopted to detect the second physical value including a temperature.

6. The image forming apparatus according to claim 1, wherein said at least one of the image forming units is adopted to perform the developer discard mode in which a static latent image is formed on the image supporting member, the developer is attached to the static latent image from the developer supporting member to form a developer image, and the cleaning member cleans the developer image.

7. The image forming apparatus according to claim 1, further comprising a printed sheet number measuring unit for measuring a number of media printed, said control unit determining whether the at least one of the image forming units performs the developer discard mode when the number of the media printed reaches a specific number.

8. An image forming apparatus comprising:

a plurality of image forming units each having an image supporting member, a developer supporting member, and a cleaning member disposed to face the image supporting member for cleaning developer on the image supporting member;

a transfer device for transferring a developer image formed on the image supporting member to a medium;

a fixing device for fixing the developer image to the medium through heat; and a control unit for controlling the image forming units so that one of the image forming units situated closer to the fixing device performs a developer discard mode in which the developer is discarded from the developer supporting member to the image supporting member more frequently than other of the image forming units.

9. The image forming apparatus according to claim 8, wherein said at least one of the image forming units is adopted to perform the developer discard mode in which a static latent image is formed on the image supporting member, the developer is attached to the static latent image from the developer supporting member to form a developer image, and the cleaning member cleans the developer image.

10. The image forming apparatus according to claim 8, further comprising a printed sheet number measuring unit for measuring a number of media printed, said control unit determining whether the at least one of the image forming units performs the developer discard mode when the number of the media printed reaches a specific number.

11. A method of discarding developer in an image forming apparatus including a plurality of image forming units each having an image supporting member, a developer supporting member, and a cleaning member disposed to face the image supporting member for cleaning developer on the image supporting member; a transfer device for transferring a developer image formed on the image supporting member to a medium; a fixing device for fixing the developer image to the medium through heat, comprising the steps of:

detecting a first physical value of an external environment of the image forming apparatus;

detecting a second physical value of an internal environment of the image forming apparatus; and determining whether at least one of the image forming units performs a developer discard mode in which the developer is discarded from the developer supporting member to the image supporting member according to the first physical value, the second physical value, and a distance between the at least one of the image forming units and the fixing device; and discarding developer from the developer supporting member to the image supporting member.

12. The method of discarding developer according to claim 11, wherein, in the step of detecting the second physical value, said second physical value is detected in each of the image forming units.

13. The method of discarding developer according to claim 11, wherein, in the step of detecting the first physical value, said first physical value includes an absolute water vapor amount determined from a temperature outside the image forming apparatus and a relative humidity.

14. The method of discarding developer according to claim 11, wherein, in the step of detecting the second physical value, said second physical value includes a temperature.

15. The method of discarding developer according to claim 11, wherein, in the step of determining whether the at least one of the image forming units performs the developer discard mode, in said developer discard mode, a static latent image is formed on the image supporting member, the developer is attached to the static latent image from the developer supporting member to form a developer image, and the cleaning member cleans the developer image.

* * * * *